US009784018B2

(12) United States Patent
Cooper

(10) Patent No.: US 9,784,018 B2
(45) Date of Patent: Oct. 10, 2017

(54) LUGGAGE TRACKING DEVICE, SYSTEMS AND METHODS

(71) Applicant: Lantrn Limited, Causeway Bay (HK)

(72) Inventor: Aaron Cooper, Repulse Bay (HK)

(73) Assignee: Lantrn Limited, Causeway Bay (HK)

( * ) Notice: Subject to any disclaimer, the term of this patent is extended or adjusted under 35 U.S.C. 154(b) by 0 days.

(21) Appl. No.: 15/310,966

(22) PCT Filed: Jul. 21, 2015

(86) PCT No.: PCT/IB2015/055506
§ 371 (c)(1),
(2) Date: Nov. 14, 2016

(87) PCT Pub. No.: WO2016/012932
PCT Pub. Date: Jan. 28, 2016

(65) Prior Publication Data

US 2017/0074002 A1 Mar. 16, 2017

Related U.S. Application Data

(60) Provisional application No. 62/026,812, filed on Jul. 21, 2014.

(51) Int. Cl.
*E05B 65/52* (2006.01)
*E05B 35/10* (2006.01)
(Continued)

(52) U.S. Cl.
CPC ..... *E05B 65/523* (2013.01); *E05B 35/105* (2013.01); *E05B 37/0034* (2013.01);
(Continued)

(58) Field of Classification Search
CPC ..... E05B 45/06; E05B 73/0017; E05B 41/00; E05B 65/52; E05B 19/0005;
(Continued)

(56) References Cited

U.S. PATENT DOCUMENTS 6,227,020 B1 * 5/2001 Lerchner ..... E05B 17/147 70/278.3
6,318,137 B1 * 11/2001 Chaum ..... E05B 49/002 340/5.67
(Continued)

FOREIGN PATENT DOCUMENTS

CN 101336770 A 1/2009
CN 102611992 A 7/2012
(Continued)

OTHER PUBLICATIONS

International Search Report and Written Opinion dated Nov. 27, 2015 issued in connection with PCT/IB2015/055506.

*Primary Examiner* — George Bugg
*Assistant Examiner* — Munear Akki
(74) *Attorney, Agent, or Firm* — Downs Rachlin Martin PLLC

(57) ABSTRACT

A luggage tracking device (100), method and system. The luggage tracking device (100) includes a tracking device for capturing information, including location information received from a network and state information from at least one or more locks of an item of luggage. The luggage tracking device (100) may be configured for integration within the item of luggage. There is also provided a locking apparatus (300) for securing an item of luggage. The locking apparatus (300) has a locking element (304) which is movable between a first locked state and a second unlocked state. The apparatus includes a first locking means operable to control movement of the locking element. The apparatus also includes a first sensor (111) associated with the first locking means for detecting operation of the first locking means.

23 Claims, 7 Drawing Sheets

(51) Int. Cl.
*E05B 37/00* (2006.01)
*E05B 39/00* (2006.01)
*E05B 39/04* (2006.01)
*E05B 47/00* (2006.01)

(52) U.S. Cl.
CPC ..... *E05B 39/005* (2013.01); *E05B 39/04* (2013.01); *E05B 65/52* (2013.01); *E05B 2047/0069* (2013.01)

(58) Field of Classification Search
CPC ..... E05B 37/025; B60R 25/1001; G06K 19/07798; G08B 13/1427; G08B 17/10; A45C 11/184; G08C 23/04
USPC ..... 340/542, 426.28, 539.31, 572.9, 568.1, 340/568.7, 4.42, 693.5, 5.73, 5.55, 5.32; 70/432, 277, 69, 283.1, 63, 25, 15
See application file for complete search history.

(56) References Cited

U.S. PATENT DOCUMENTS 7,581,422 B2 * 9/2009 Schindler ..... B60R 25/045 70/252
8,068,023 B2 11/2011 Dulin et al.
8,739,586 B2 * 6/2014 Yuan ..... E05B 47/026 292/144
2006/0260369 A1 * 11/2006 Lai ..... E05B 37/025 70/38 C
2006/0266084 A1 * 11/2006 Kuo ..... E05B 35/105 70/21
2009/0038352 A1 * 2/2009 Yamaguchi ..... B60R 7/06 70/237
2009/0071208 A1 3/2009 Wang
2009/0205384 A1 * 8/2009 Pomerantz ..... G07C 9/00309 70/278.3
2009/0226050 A1 * 9/2009 Hughes ..... A45C 13/18 382/124
2010/0188190 A1 * 7/2010 Pukari ..... E05B 47/063 340/5.6
2013/0036777 A1 * 2/2013 Lin ..... G01G 19/58 70/30
2013/0055773 A1 3/2013 Li
2013/0264128 A1 * 10/2013 Plato ..... E05B 39/00 177/132
2014/0107868 A1 4/2014 Digiacomcantonio et al.
2014/0202220 A1 * 7/2014 Denison ..... E05B 47/0603 70/267
2015/0204110 A1 * 7/2015 Boutelegier ..... E05B 47/0012 292/138
2015/0348347 A1 12/2015 Diz et al.

FOREIGN PATENT DOCUMENTS

CN 102780772 A 11/2012
CN 103519536 A 1/2014
CN 102942672 A 7/2014
CN 204070957 U 1/2015
CN 204930625 U 1/2016
EP 2737820 A1 6/2014
JP 4759934 B2 8/2011
WO 2013154692 A1 10/2013

* cited by examiner

LUGGAGE TRACKING DEVICE, SYSTEMS AND METHODS

FIELD OF THE INVENTION

The present invention relates to luggage tracking and monitoring devices, systems and methods.

BACKGROUND OF THE INVENTION

According to the 2014 annual SITA Baggage Report, the World Tracer statistics reported that there were 3.13 billion airline passengers in 2013, representing a 5.1% increase over 2012. As more individuals around the globe transition into the middle class, this figure will only increase and, despite efforts to reduce the number of mishandled luggage, a huge amount of luggage invariably goes missing every year.

In 2013, 21.8 million pieces of luggage were mishandled, a figure that equates to 6.96 bags per 1,000 passengers, with 3.3% of items never being recovered. These figures cost the aviation industry $2.09 billion in 2013 alone.

According to the 2015 annual SITA Baggage Report, there were 3.3 billion airline passengers in 2014, representing a 5.4% increase over 2013. As more individuals around the globe transition into the middle class, this figure will only increase and, despite efforts to reduce the number of mishandled luggage, a huge amount of luggage invariably goes missing every year.

In 2014, 24.1 million pieces of luggage were mishandled, a figure that equates to 7.3 bags per 1,000 passengers, with 5.5% of items never being recovered. These figures cost the aviation industry $2.4 billion in 2014 alone.

This is a known problem within the airline industry; however, no effective solutions have been implemented. Airports and airlines are beginning to adopt radio-frequency identification (RFID) models to aid the tracking of luggage, but these tracking capabilities are restricted to being within the range of a scanner.

Individual tracking devices have also been developed as a means of informing end users of their luggage location, but again, these services are unreliable, limited to only transmitting information pertaining to physical location and exposed to potential damage. In addition, attempts have been made to enhance automation and efficiency in regards to the luggage transferring process, such as pick up from home services with accompanying baggage tag systems, which are also imperfect due to the increased probability for further luggage mishandling.

U.S. Pat. No. 8,742,922 B2 discloses a luggage-tracking device that is configured to be attached to a piece of luggage and a location unit to determine a current location of the device. This device has only locating capabilities and is susceptible to unauthorized access, being attached to the outside of a luggage article hence providing users with access to internal components of the tracking device from the outside. Having a device placed externally also increases the chances for luggage mishandling.

U.S. Pat. No. 7,535,358 B2 discloses an electronic luggage tag that uses GPS technology to both track luggage, and record the specific times and places that a specific piece of luggage is opened. This device is lacking automation and requires the user to replace batteries and also remember to input the device into an appropriate location, i.e. where functionality of the device is exposed to sufficient lighting for sensor functionality to work, within a luggage article every time a traveller uses the item. In addition, to provide the device functionality requires high power usage. Furthermore, the device does not provide adequate information as to the reason a luggage article may have been manipulated.

U.S. Patent Publication No. 2014/0151173 discloses a luggage article with a display and a communication system for luggage articles. The design consists of numerous functions, such as cameras, internal and external display units, numerous environmental sensors and weighing scales, quickly deplete the product's battery life, even if a large power source is included. This will also enhance probability of increased levels of damage, increases the weight of a luggage article (which is becoming an increased concern for airlines and airports), in addition to being extremely intrusive on luggage specifications and therefore requires sufficient resources to enable such functionality.

Moreover, passengers currently have limited control over the luggage process and recent surveys suggest that travellers now seek more engagement in the luggage handling process when travelling. According to SITA's 2013 Passenger IT Trends Survey, the need for self-service has increased; with over 50% of these individuals stating that they would actively use baggage status information if it were available to them. In 2014, a survey indicated that half of all passengers see room for improvement with their travel experience, with over 48% of these individuals stating that their most frustrating aspect of travel is managing their baggage.

A further key concern for passengers during transit is luggage security. Passengers are often required to part with their luggage and, in so doing, have limited control of who may gain access to their luggage. For example, when an airline passenger wishes to place an item of luggage in the aircraft hold, the passenger must hand the luggage over to the airport security so that the luggage can be screened and transported to the hold. An airline passenger therefore no longer has any control over who may access their luggage and places a great deal of trust in airport staff. Another example is when a passenger is on a train or a coach and must store their luggage in a location remote from their seat which is out of sight. In such circumstances, the passenger must trust that members of the general public will not attempt to gain access to the luggage and steal items therefrom. A further example is when a passenger is temporarily separated from their carry-on at security checkpoints, such as immigration, and also while on an aircraft when the carry-on is stowed away in the overhead bin.

Unfortunately, members of luggage handling staff and the general public can sometimes succumb to temptation and gain entry to items of luggage in order to steal valuables. Whilst most modern day luggage comprise locking mechanisms to prevent unauthorised access, sometimes the locks can be bypassed either by force or some other mode of access.

In the United States of America, for example, it is a requirement that the Transportation Security Administration (TSA), which screens every passenger's luggage before it is placed on an airplane, has access to luggage without the passenger being present. This is because there are instances when airport security need to physically inspect a piece of luggage for security purposes. As a consequence of this, the TSA has worked with several companies to develop locks that can be opened by airport security personnel using universal "master" keys so that the locks do not have to be cut. However, this provides airport security personnel with easy access to a passenger's personal, and potentially valuable, belongings.

Therefore, there are several instances during transit in which an unauthorised individual may gain access to a passenger's luggage without the passenger being present. Particularly for air travel, it is important that a passenger can identify when their luggage has been accessed and when an item may have been stolen. Identifying a more precise period of time in which luggage may have been stolen can help to identify who handled the luggage and, therefore, narrow down the list of possible suspects. In addition, to make a claim against an airline or transport administration, a passenger is typically required to report a theft or incident whilst they are still airside. The moment a passenger leaves, the problem becomes a police matter and not an airline or airport problem. Quickly identifying a luggage breach and/or theft can therefore help to safeguard a passenger's rights.

In view of the above, there is a need for an apparatus and system for monitoring the unauthorised access of an item of luggage and alerting the owner of the luggage of any such instance of unauthorised access.

SUMMARY OF THE INVENTION

In a first aspect of the present invention, there is provided a locking apparatus for securing an item of luggage comprising a locking element which is movable between a first position in which the locking apparatus is in a locking state and a second position in which the locking apparatus is in an unlocked state, a first locking means operable to control movement of the locking element between the first position and the second position, and a first sensor arranged to detect operation of the first locking means and/or movement of the locking element.

Advantageously, by monitoring actuation of the locking means, it is possible to determine when the locking apparatus was actuated or if an attempt was made to actuate the locking apparatus so that the event can be recorded and relayed to a user of the locking apparatus. By enabling a user to determine if an actuation or attempted actuation event took place, the user can quickly check the contents of an item of luggage with which the locking apparatus is associated to determine whether any items are missing and to notify the appropriate authorities.

The first sensor may be associated with the first locking means for detecting operation of the first locking means. The first sensor may be associated with the locking element for detecting movement of the locking element. There may be a second sensor associated with the locking element for detecting movement of the locking element.

The first locking means may comprise a mechanically actuated locking mechanism. The mechanically actuated locking mechanism is a key operable locking mechanism.

The locking apparatus may further comprise a second locking means operable to control movement of the locking element between the first position and the second position. The locking apparatus may further comprise an additional sensor associated with the second locking means for detecting operation of the second locking means.

Advantageously, a locking apparatus with two locking mechanisms and having a first sensor associated with the first locking means and/or the locking element and a second sensor associated with a second locking means it is possible to distinguish between different actuation events. By monitoring actuation of the first locking means and/or monitoring movement of the locking element and monitoring actuation of the second locking means, it is possible to determine which locking mechanism has been used to unlock the locking apparatus.

The second locking means may comprise a mechanically actuated locking mechanism. The second mechanically actuated locking mechanism may comprise a combination locking mechanism.

The locking element may comprise a bar which is linearly movable between the first and second positions.

One or more of the sensors may be electronic sensors. One or more sensors may comprise a tactile sensor configured to detect the application of a physical force. A tactile sensor may be disposed proximate to the first locking means so as to be physically contacted when the first locking means is operated. One or more sensors may comprise a position sensor operable to detect movement.

The locking apparatus may further comprise a processing means for processing data from the one or more sensors. The processing means may be configured to distinguish between attempted actuation events based upon detected physical forces or movements over a period of time. The processing means may be configured to determine when the locking element has moved between the first position and the second position.

The locking apparatus may further comprise a transmitter for wirelessly transmitting data. The locking apparatus may further comprise a receiver for receiving wireless data transmissions. The locking apparatus may further comprise data storage means for storing data. The data storage means may be configured to store information about a user of the locking apparatus and/or the predetermined activities of the user and/or events that have been detected by the locking apparatus over a period of time.

In a second aspect of the present invention, there is provided a locking apparatus comprising:

a housing;

a locking element movable relative to the housing between a first position in which the locking apparatus is in a locking configuration and a second position in which the locking apparatus is in an unlocking configuration;

a key cylinder extending at least partially into the housing and operated by a key, the key cylinder configured to restrict movement of the locking element from the first position to the second position when the key cylinder is set to a locking state, the key cylinder configured to permit movement of the locking element from the first position to the second position when actuated by a key;

a combination lock configured to restrict movement of the locking element when the combination lock is in a locking state and to permit movement of the locking element when the combination lock is in a predefined combination;

a first sensor actuable by a key inserted into the key cylinder;

a second sensor actuable by movement of the locking element between the first position and the second position;

a central processing unit to process data received from the first sensor and the second sensor;

a memory to store data processed by the central processing unit; and a transceiver to transmit and receive wireless signals comprising data received from the first and second sensors.

The memory may be configured to store data relating to a user of the locking apparatus, events recorded by the locking apparatus over a period of time and/or information relating to predetermined activities of a user of the locking apparatus.

In a third aspect of the present invention, there is provided an item of luggage comprising a locking according to the first or second aspects.

In a fourth aspect of the present invention, there is provided a method of monitoring the locking status of a locking apparatus associated with an item of luggage comprising the steps of:

monitoring a locking mechanism to detect actuation of the locking mechanism; and storing as data one or more detected actuations in a memory.

The method may further comprise the step of monitoring movement of a locking element to detect movement of a locking element.

The method may further comprise the step of monitoring a second locking mechanism to detect actuation of the second locking mechanism.

The method may further comprise the step of transmitting data related to one or more detected actuations or movements to an electronic device remote from the locking apparatus.

In a further embodiment of the present invention there is provided a unique and innovative solution for increasing the visibility of the baggage management process from an end user perspective, enhancing the efficiency behind the procedures involved with reuniting travellers with mishandled luggage articles. Preferably, an embodiment of the present invention provides an integrated luggage lock-tracking model that locates a luggage articles physical location and monitors individual condition changes of a luggage article.

Advantageously, an embodiment of the present invention provides an integratable luggage tracking device applicable to any luggage article design without significant modifications.

Advantageously, in an aspect of the present invention, the user can remotely track the location and individual condition of a traveller's luggage article, resulting in increased peace of mind for passengers, as well as, reuniting mishandled luggage if required.

In a fifth aspect of the invention there is a provided optional accompanying online user interfaces of benefit to marketing efforts by enhancing targeted reach and engagement in the form of advertisements. This is only possible as the present concept design can cater to a more widespread audience, adding commercial value on a larger scale. Furthermore, by capturing data relating to a passenger's travel experience and transit time, it is possible through analysis of the captured data to identify operational issues and implement improvements.

The foregoing device may achieve the above stated advantages by including transmitting components that may be configured to communicate Global Positioning System (GPS) and Global System for Mobile (GSM) signals.

The luggage-tracking device may also include sensor units configured to detect state changes in the condition of a luggage article, i.e. TSA or combination lock/unlock, tampering, low battery, airplane mode and sleep mode, which may be located in the luggage-tracking device and a luggage article's locking mechanisms.

The information gathered from data source units, i.e. transmitter units and sensor units may be processed and stored in a GSM module that may include a controller unit and memory/storage unit. This data may then be configured and transmitted across high priority GSM networks using USSD messaging, or any other form, thereby incurring much lower roaming charges than standard network charges. The use of USSD messaging extends the wireless communication reach of the tracking device and lowers power consumption.

The USSD messages may be sent to an Application Programming interface (API) end point that enables communication between the device and a chosen server or uniform resource locator (URL). This end point may then process and configured the data in a format that displays a summary of an articles location and condition on smart phone applications or any other form. Changes in predefined conditions may also be configured to alert travellers of sudden state changes through the use of push notification systems or any other form.

The tracking device may be strategically placed in a luggage article's interior to advantageously be connected to numerous luggage article-locking mechanisms.

The luggage tracking device may also include a power source that is configured to automatically switch between online and offline mode during take-off, taxiing and landing, in addition to when a luggage article is inactive and subject to no movement over the course of a predefined time period. This may be achieved through the use of sensor units that can detect motion.

In accordance with a seventh aspect of the present invention, there is provided a luggage tracking device comprising a receiver for receiving data from one or more remote electronic communication devices, a transmitter for transmitting data to one or more remote electronic communication devices, a processing means for processing data, wherein the processing means is configured to determine the location of an item of luggage with which the luggage tracking device is associated and transmit determined location information to a remote electronic device.

In accordance with a seventh aspect of the present invention, there is provided a system for tracking and monitoring an item of luggage comprising a locking apparatus according to the first or second aspects and a tracking device according to the fifth aspect.

In accordance with an eighth aspect, there is provided a system for tracking and monitoring an item of luggage comprising:

a locking apparatus comprising one or more locking mechanisms, one or more sensors for detecting actuation by the one or more locking mechanisms, a processor for processing data from the one or more sensors to identify an actuation event, and a transmitter for transmitting details of an actuation event to a remote device; and a tracking device comprising a receiver for receiving one or more signals comprising location information data, a processor for processing data received by the receiver to determine location information, and a transmitter for transmitting location information to a remote device.

The system may further comprise a remote device comprising a receiver for receiving data transmitted by the locking apparatus and the tracking device, a processor for processing data received from the locking apparatus and the tracking device, a graphical user interface and a software module for displaying the processed data on the graphical user interface.

The system may further comprise a server computer having communication means for communicating with and receiving data from the locking apparatus, tracking device and remote device, storage means for storing data received from the locking apparatus, tracking device and remote device and one or more software programs configured to transmit status and location information to the remote device.

Other advantages of the present invention are apparent in the following descriptions.

DETAILED DESCRIPTIONS OF THE PREFERRED EMBODIMENTS

Figure 1:
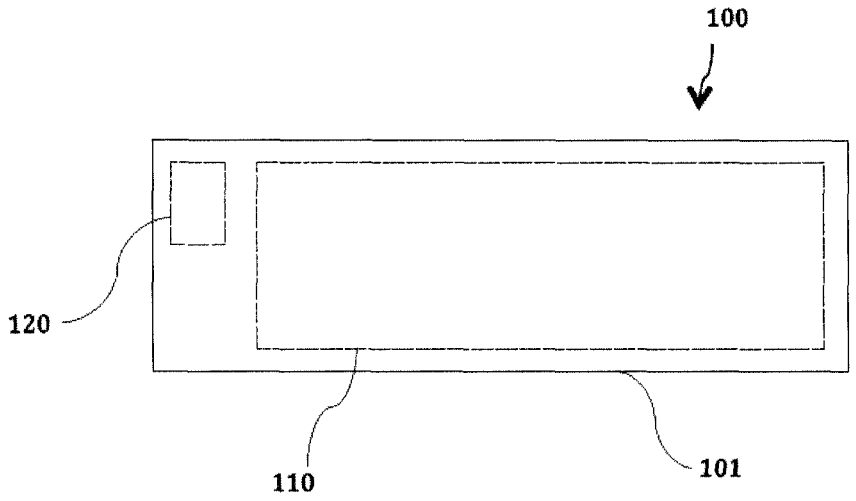
FIG. 1: depicts a luggage-tracking device, in a first exemplary embodiment of the present inventive invention.

FIG. 1 depicts luggage tracking device 100 that is housed 101 inside a luggage article 140, such that it is not accessible from the outside of the luggage article. This device directly integrates with the luggage article's locking mechanism 130 during the manufacturing stage of a luggage article 140.

It would be appreciated that a luggage manufacturer may appropriately select the location of the tracking device, and attached using conventional means in the art such as glue, screwing or any other method that prevents a luggage lock-tracking device 100 from being removed.

Figure 4:
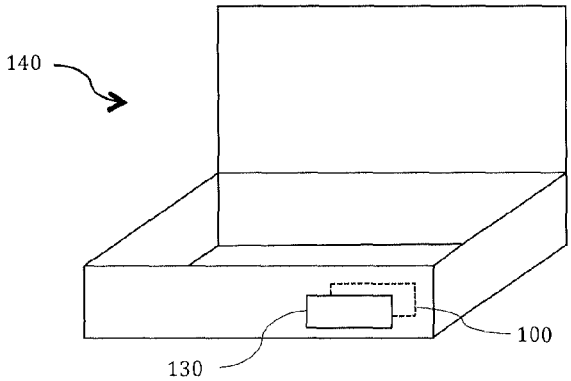
FIG. 4: depicts the location of an exemplary luggage-tracking device of FIG. 1 in a first location.

A number of locations of the tracking device would be possible. Referring to FIG. 4 a luggage tracking device 100 is placed and permanently attached directly behind the locking mechanism 130 of the luggage article 140 as an integral component or in another interior location.

Figure 5:
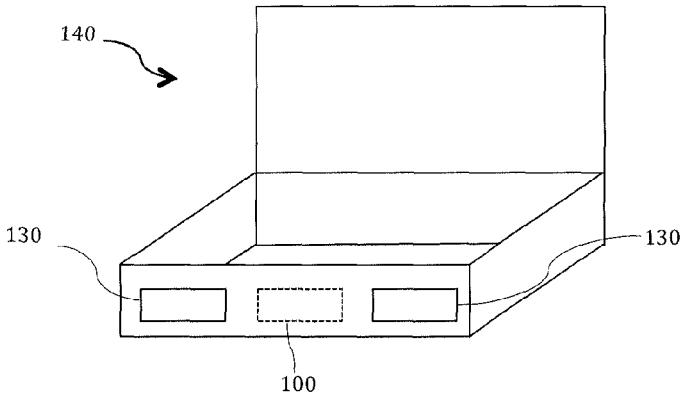
FIG. 5: depicts an exemplary luggage-tracking device of FIG. 1 in yet a further location.

Alternatively, a luggage-tracking device 100 may also be included in a luggage article with multiple locking mechanisms 130 to connect all locking mechanisms 130, such as illustrated in FIG. 5.

Figure 2:
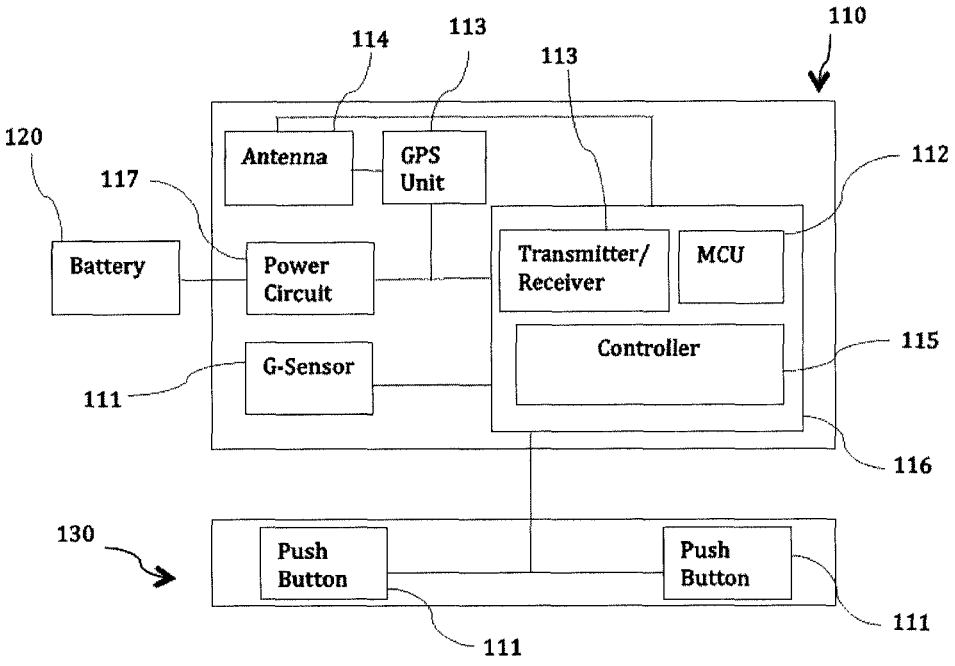
FIG. 2: depicts a schematic system of a luggage-tracking device according to an embodiment of the first embodiment depicted in FIG. 1.

The tracking device is considered in more detail in FIG. 2 which depicts the luggage-tracking device's 100 printed circuit board (PCB) 110 mechanically supporting and electrically connecting components.

The PCB 110 may support a GSM module unit 116 that incorporates a controller unit 115, for example a central processing unit (CPU) or accelerated processing unit (APU), a transmitter/receiver unit 113, for example a GSM/GPRS component, and a memory unit 112, for example a read and write MCU that may be configured for storing information retrieved from sensors 111 and transmitter/receiver units 118.

The PCB 110 may also support sensors 111, for example g-sensors configured to disable or enable transmitting capabilities respectively during take-off, taxiing and landing. These sensors 111 may also be configured to recognize non-movement for a predefined period of time that automatically communicates an instruction to switch the luggage-tracking device 100 into "sleep mode", also disabling transmitting capabilities. The luggage-tracking device 100 may then return to "online mode" once the luggage tracking device 100 data source, i.e. sensors 111, detects movement.

Optionally, the PCB 110 may also include other sensors such as push button sensors to determine tampering alerts and TSA lock and combination unlock/lock states. A further transmitter 113, may be included, for example a component configured to transmit/receive GPS signals, together with an antenna-tuning unit 114. This antenna unit 114 would improve power transfer between transmitting units 113 and its antenna to amplify an electrical signal for transmission to one or more remote electronic communication devices, with the overall tracking device being powered by a power circuit unit 117, for providing power to components of the PCB 110.

All components of the PCB 110 may be coupled with the GSM module unit 116, with the antenna-tuning unit 114 being coupled with a transmitting unit 113. The transmitting unit 113 is further coupled with the GSM module unit 116.

The luggage-tracking device 100 may be provided electricity from a power source unit 120. In particular it would be appreciated that a battery could provide electronic power to a power circuit unit 117 coupled with a transmitter unit 113, hence the battery 120 ultimately powering all components within the PCB 110 and locking mechanisms 130.

When a user first purchases a luggage article that has an integrated smart luggage lock tracking device 100 the user may need to sign up to the accompanying online platform and register their product in order to activate the device 100. According to various exemplary embodiments, the device may include a data port that provides activation functionality and a means to recharge the luggage-tracking device 100.

The end user may then be required to download an online application, i.e. smart-phone app or any other form, to access information recorded, received, processed, stored and transmitted by the luggage device 100.

All information may be preconfigured to be transmitted on a real time basis at predefined intervals with online platforms.

Optionally the device may be programmed, at the user's discretion, to enable alert functions, in order to keep end users informed of any sudden predefined state changes, i.e., TSA or combination lock/unlock, tampering attempts, airplane mode, sleep mode, offline (actuable by a switch) and online mode.

According to various exemplary embodiments, the luggage tracking device 100 may be provided with a backup reset button to ensure the luggage tracking device 100 is working appropriately, for example turning on and off and transmitting.

In a further exemplary embodiment, if data is unavailable from GPS signals the device 100 will attempt to triangulate its location via GSM networks or any other network within range.

The online platforms may enable users to locate the exact location between their handheld devices, i.e. smart-phones or any other device, from which they are accessing the accompanied online downloaded application, and the luggage tracking device 100, ensuring enhanced solutions for monitoring the condition and efficiently locating a luggage article.

Figure 3:
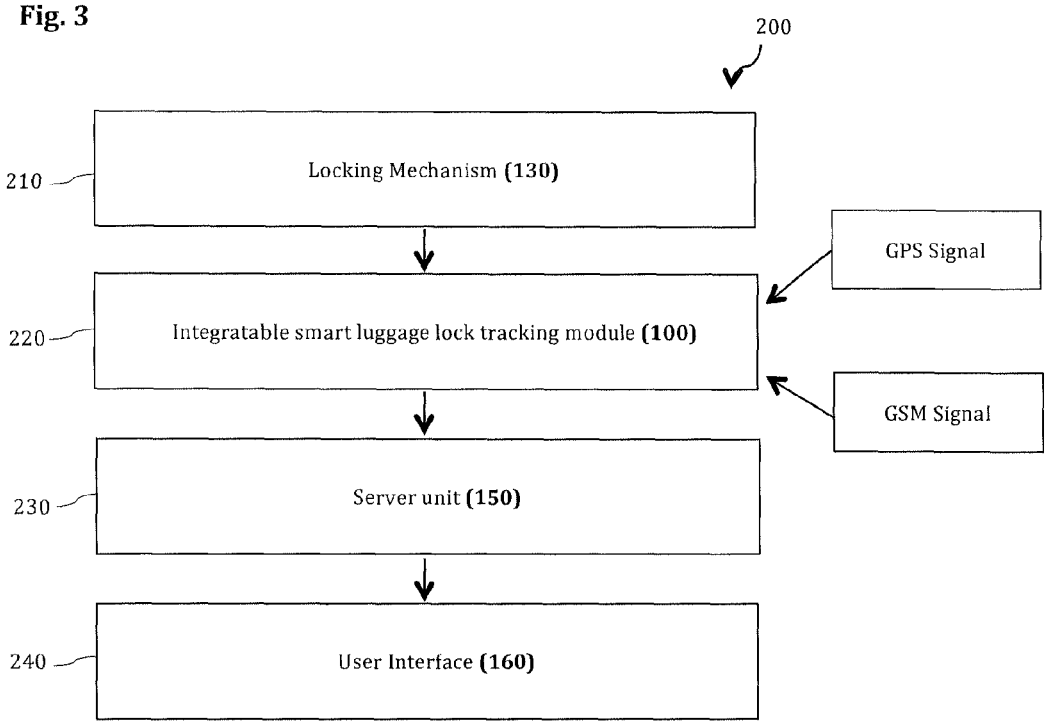
FIG. 3: depicts an exemplary process flow diagram showing tracking and monitoring the condition of luggage articles according to the first embodiment of the present invention.

FIG. 3 illustrates the overall operation 200 method for tracking the location and condition of a luggage article 140 that having a luggage-tracking device 100, according to an exemplary embodiment.

In normal operational conditions 210, data may be received from sensors 111, i.e. push buttons or any other form, which may then be transferred, recorded and processed in a luggage-tracking device's 100 GSM module unit 116.

At the same time, in operation 220, data may be received from operation 210 with additional data possibly being recorded, which may relate to information gathered from, for example, a power source unit 120, sensors 111 and a transmitter unit 113.

Preferably, this information may be communicated by sending Unstructured Supplementary Services Data (USSD) messages across high priority GSM network channels, or any other method, that may be received by an end point, for example an API or URL. This may reduce power consumption and enhance the reliability of the transmitting capabilities of the luggage lock-tracking device 100.

Information recorded, stored and sent from operation 220 may then be processed, recoded and stored by a server unit 150, for example a cloud server, as illustrated in operation 230.

This information may then be recoded and configured in a compatible format that may display information gathered from data sources in operation 220 to end users, i.e. travellers, on smart phone applications, or any other form.

In addition, operation 230 may also be configured to manage scalability and data transfer to operation 240 in the form of push notifications, which may enable end users to view alerts for when a luggage-tracking device 100 detects condition state changes.

Figure 6:
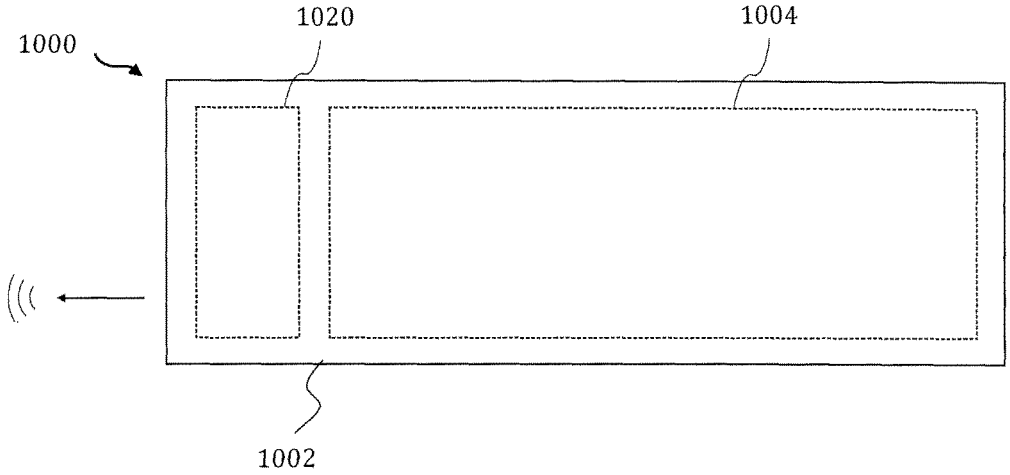
FIG. 6: depicts a schematic representation of a tracking device according to the present invention.
Figure 7:
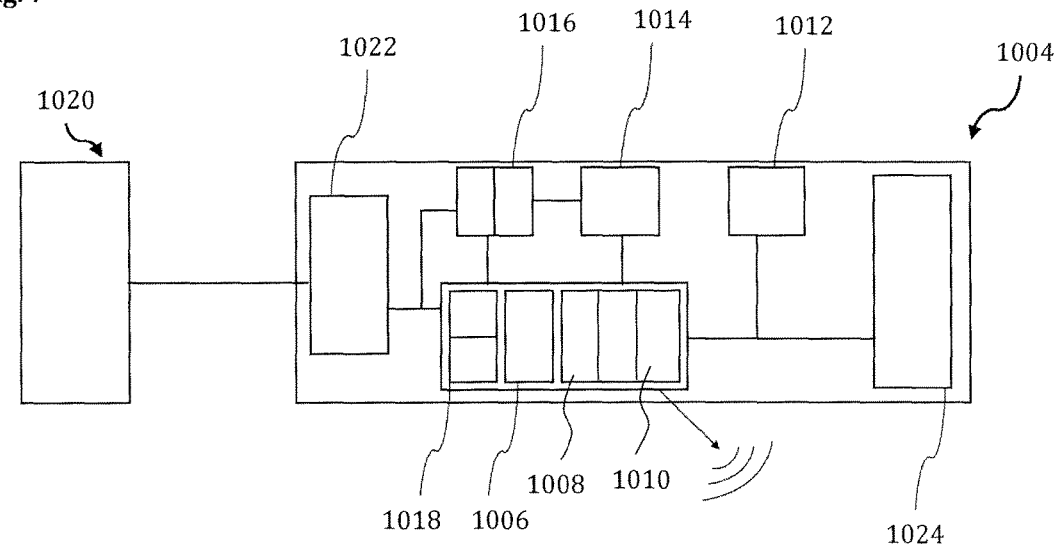
FIG. 7: shows a schematic representation of electronic components of the tracking device shown in FIG. 6.

With reference to FIGS. 6 and 7, in a second embodiment of the present invention, the tracking device 1000 may comprise a self-contained portable device. The portable tracking device 1000 comprises a housing 1002 made from rigid plastics material or other suitably robust material. Advantageously, the portable tracking device 1000 gives a user the option of including the tracking device in any item that requires monitoring. Therefore, the device is not confined for use in a particular item of luggage.

The tracking device 1000 houses a processing module 1004 which provides tracking information and enables wireless communication of the information to remote electronic communication devices such as smartphones, computers, networking apparatus and other programmable apparatus.

The processing module 1004 comprises a memory 1006, a memory controller 1008, one or more processing units (CPUs) 1010, an accelerometer 1012, a global positioning satellite (GPS) module 1014, at least one signal booster 1016, and radio frequency circuitry 1018 for transmission and receipt of wireless signals. The electronic components communicate over one more communication buses and are powered by a power system which comprises a power source 1020 such as a battery, a power management and recharging system 1022 and any other components associated with the generation, management and distribution of power. The processing module 1004 further comprises an array of light emitting diodes 1024 operable to emit light in response to actuation by a user of the device 1000.

The memory 1006 comprises a non-volatile solid state memory with read/write capabilities. Access to the memory 1006 by other components of the device such as the CPU 1010 and the GPS module 1014 is controlled by the memory controller 1008. The GPS module 1014 is configured to receive wireless signals from one or more global positioning satellites so that the location of the tracking device 1000 can be determined by the processing module 1004. Thus, the tracking device 1000 can periodically determine its position and record the location of the device at a particular time in the memory 1006.

The radio frequency circuitry 1018 comprises a radio frequency transceiver and is operable to convert electrical signals into electromagnetic waves and vice versa so that the tracking device 1000 can transmit and receive wireless signals to and from remote communication devices such as handheld devices, other luggage tracking/monitoring communication devices, computers, computer networks or other programmable apparatus. The radio frequency circuitry 1018 is configured to communicate wirelessly using any of a plurality of communication standards, protocols and technologies such as Global System for Mobile Communications (GSM), Bluetooth, Wireless Fidelity (Wi-Fi), ZigBee or any other suitable communication protocol.

The signal booster 1016 comprises GPS and GSM booster antennas which enhance the transmission and receipt capabilities of the device. The signal booster 1016 also comprises a signal amplifier operable to amplify an electrical signal for transmission to one or more remote electronic communication devices. Thus, the tracking device 1000 is capable of transmitting and receiving electromagnetic waves in areas of limited reception such as an aircraft cargo or deep building interior.

The tracking device 1000 additionally comprises an RFID tag (not shown) operable to receive radio signals from appropriately positioned RFID readers. The RFID tag stores identification information for transmission upon interrogation from an RFID reader. In the event an airport comprises a plurality of RFID readers spaced along a luggage security processing line at known locations, the RFID readers can detect the RFID tag of the device 1000. Thus, depending on which RFID reader detects the RFID tag of the device, it is possible to determine where the luggage is in the security checking process so that the positional information can be relayed to the smartphone of a user or other remote electronic devices.

As with the first embodiment, the accelerometer module 1012 is configured to detect changes in acceleration of the tracking device to determine whether the device 1000 is at rest relative to the surface of the earth or, for example, subject to movement such as along a conveyor belt, during taxiing of an aircraft or during take-off or landing. Using acceleration data communicated from the accelerometer 1012, the processing module 1004 is operable to disable or enable transmitting capabilities respectively during take-off, taxiing and landing so that the GPS or Bluetooth modules 1018 do not emit wireless signals that could interfere with the functioning of aircraft at crucial times. Data from the accelerometer module 1012 can also be used by the processing module 1004 to determine appropriate times to enter into a sleep mode to conserve power, such as when at rest relative to the surface of the earth.

The CPU 1010 runs one or more software programs stored in the memory 1006 to perform functions for the tracking device 1000 and to process data. The software programs comprise a communication module and a position module. The communication module comprises a set of instructions for generating signals for transmission to other electronic communication devices and for handling data received by the RF circuitry 1018. The position module comprises a set of instructions for processing data received from other electronic communication devices via the communication module, data received from the accelerometer 1012, and data received from the GPS module 1014.

The position module is operable to determine when the tracking device 1000 should be switched between sleep, airplane and awake states based upon detected movements (or prolonged absence thereof), and also to process positional information data received from the GPS module 1014 and to record the positional information in the memory 1006 along with a time stamp. The position module is also operable to periodically transmit position information to a remote electronic communication device via the communication module.

The software programs may also comprise a light module operable to switch the LEDs 1024 between an 'on' or 'off' state in response to an appropriate user command either via a smartphone or a mechanical switch incorporated into the housing 1002 and electrically coupled to the processing module 1004.

In all other aspects the tracking device according to the second embodiment is substantially the same in function and operation as the first described embodiment.

Figure 8A:
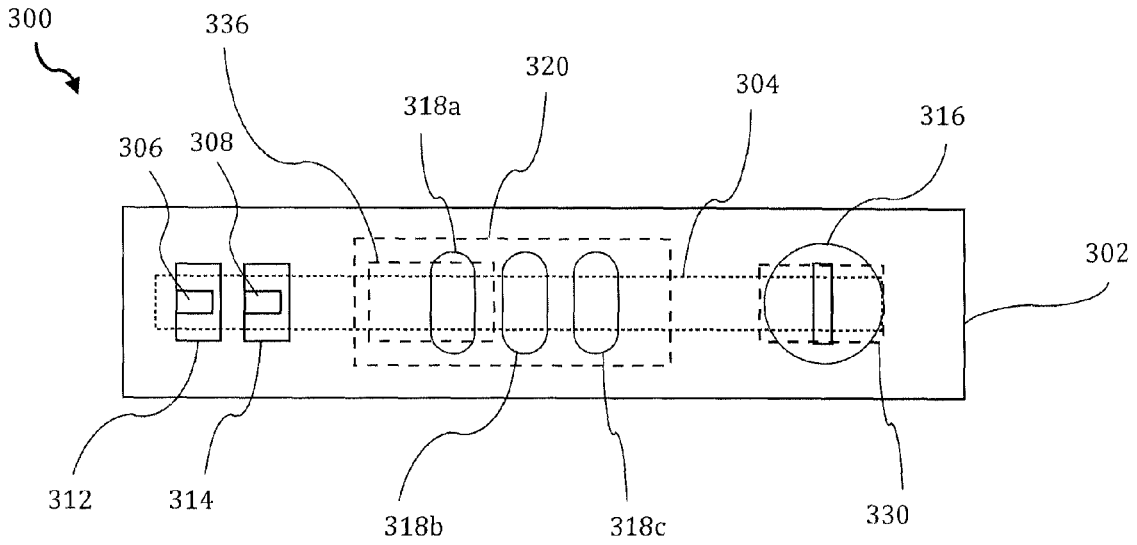
FIG. 8*a*: shows a schematic representation of a locking apparatus according to another aspect of the present invention in a locking state.
Figure 8B:
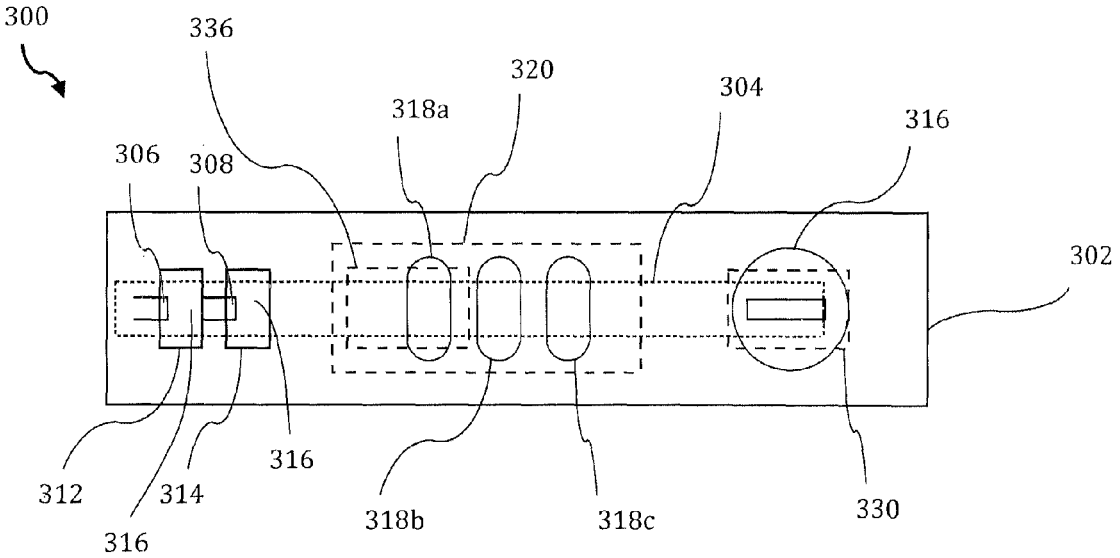
FIG. 8*b*: shows a schematic representation of the locking apparatus shown in FIG. 8*a* in an unlocking state.
Figure 9:
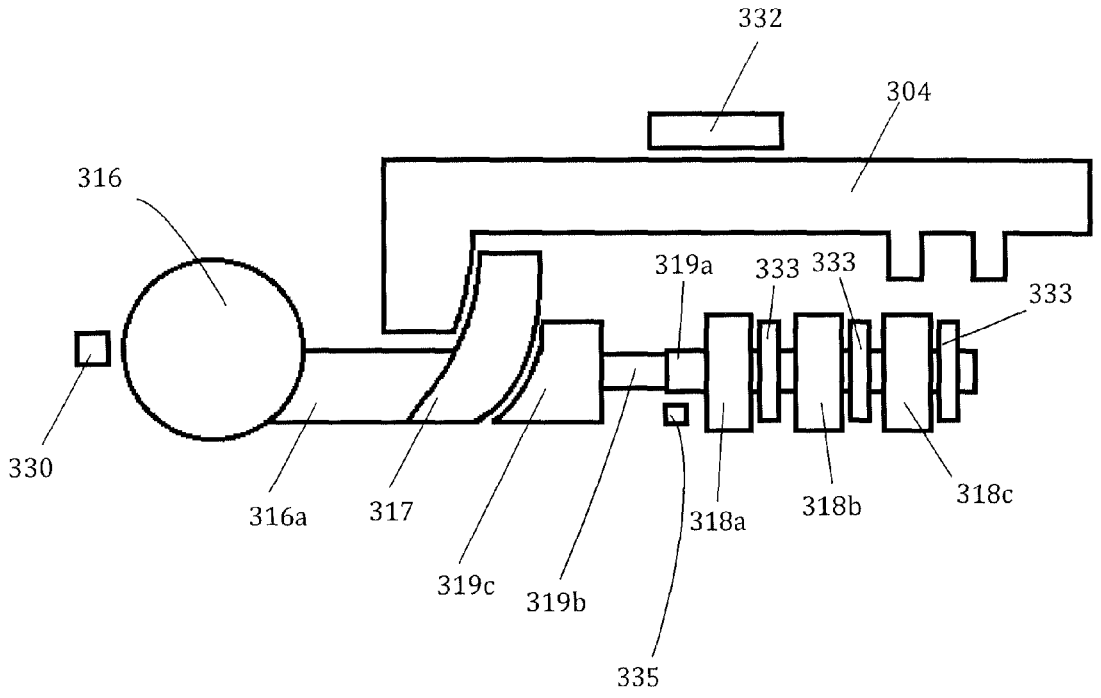
FIG. 9: shows a schematic representation of internal components of the locking apparatus shown in FIG. 8*a;*
Figure 10:
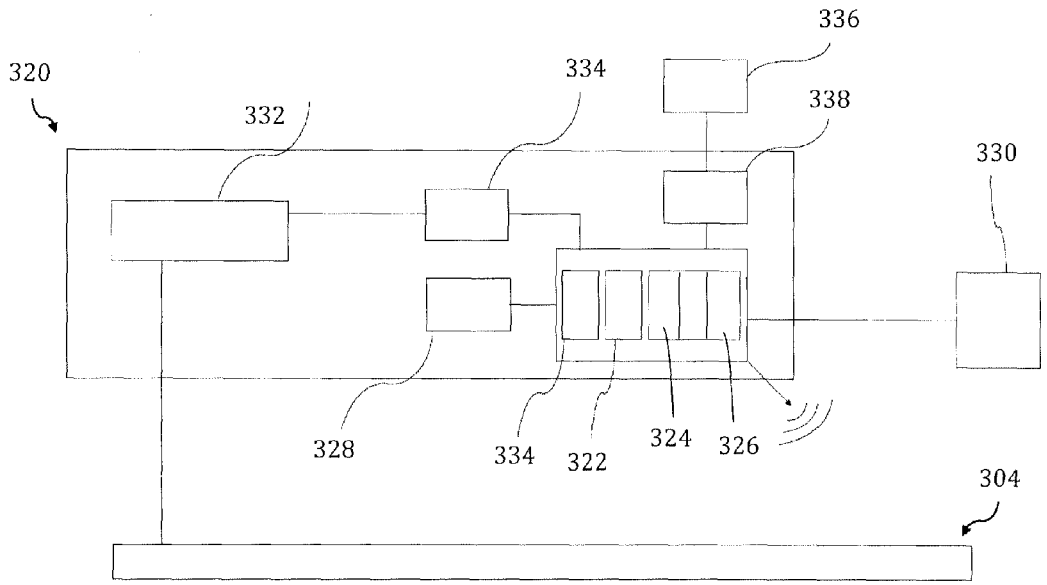
FIG. 10: shows a schematic representation of electronic components of the locking apparatus shown in FIG. 8*a;*

With reference to FIGS. 8 to 10, in a further aspect of the present invention, there is shown a locking apparatus 300 which is configured to be incorporated into a piece of luggage to secure the luggage in a closed state. The locking apparatus 300 is configured for use with a tracking device 100, 1000 as described above but may also operate in isolation.

The locking apparatus 300 comprises a housing 302 made from a rigid plastics material which is substantially cuboidal in shape and which houses a number of components for actuating the locking apparatus 300 and detecting actuation. Whilst plastics or composite material are preferred material for the housing 302 it will be apparent to the skilled person that other suitable materials may be used which have the necessary durability and strength required of a locking apparatus 300 without significantly interfering in the wireless transmission and receipt of signals.

The locking apparatus 300 comprises a locking element 304 in the form of a sliding metal locking bar which is seated within the housing 302. The sliding bar 304 is linearly moveable relative to the housing 302 between a first position in which the locking apparatus 300 is in a locking state (as shown in FIG. 8*a*) and a second position in which the locking apparatus 300 is in an unlocked state (as shown in FIG. 8*b*). The sliding bar 304 is arranged to move in a direction substantially parallel to the longitudinal axis of the housing 302.

The locking bar 304 comprises two hook shaped projections 306, 308 which are fixed relative to the locking bar 304 and which each extend from the locking bar 304 and in a direction along the longitudinal axis of the locking bar 304, each terminating at a free end. Thus a gap is formed between the two projections 306, 308 and the locking bar. The two projections are arranged to cooperate with a pair of apertures 312, 314 formed in the housing 302 of the locking apparatus 300. Each projection 306, 308 is therefore associated with a corresponding aperture 312, 314. The spacing between the two projections 306, 308 is approximately equal to the spacing between the two apertures 312, 314. The two projections 306, 308 are arranged on the locking bar 304 such that when the locking bar 304 is in the first position, each projection 306, 308 is substantially aligned with a corresponding aperture 312, 314. The two projections 306, 308 are sized and shaped such that when the locking bar 304 is in the first position (as shown in FIG. 8*a*), the two projections 306, 308 extend substantially across their corresponding apertures 312, 314. Furthermore, the two projections 306, 308 are sized and shaped such that when the locking bar 304 is in the second position (as shown in FIG. 8*b*), the two projections 306, 308 do not extend across their respective corresponding apertures. Thus, in the second position, a space 316 is formed between the free end of each projection 306, 308 and a side of the corresponding aperture 312, 314.

The two apertures 312, 314 are each shaped to receive a portion of a pull tab of a zipper (not shown). Thus, when the locking bar 304 is in the second position, a pull tab can be inserted into the space 316 between the free end of a projection 306, 308 and a side of the corresponding aperture 312, 314. The projections 306, 308 are each shaped such that they can extend through an aperture or eye formed in an end of the pull tab. Therefore, a pull tab can be arranged in the space 316 and the eye of the pull tab can be oriented so that the projection 306, 308 extends through the eye of the pull tab when the locking bar 304 and, hence, the projection 306, 308 moves from the second position to the first position. In this locking state, the projection 306, 308 extends through the eye of the pull tab across the aperture 312, 314 of the housing 302 to prevent the pull tab from being removed from the housing aperture 312, 314 in which the pull tab is seated.

The side of each projection 306, 308 that faces outwardly from the two housing apertures 312, 314 is tapered so that when part of the pull tab is inserted into an aperture 312, 314, the corresponding projection is urged in a direction away from the housing aperture 312, 314 so that the space 316 is formed between the free end of the projection 306, 308 and a side of the housing aperture 312, 314. The locking bar 304 is biased toward the locking state position by springs (not shown) so that the locking bar 304 is urged from the second position to the first position. Thus, when a pull tab is inserted into a housing aperture 312, 314 to urge the projection 306, 308 toward the second position and when the pull tab eye is oriented to be aligned with the free end of the projection 306, 308, the projection 306, 308 is urged back through the pull tab eye from the second position to the first position due to biasing of the locking bar 304.

The locking bar 304 is associated with a first locking mechanism 316 and a second locking mechanism 318. The first locking mechanism comprises a key lock 316. In the embodiment depicted, the key lock 316 is a master keyed pin tumbler lock which comprises a cylinder lock for the receipt of a master key. The master keyed pin tumbler lock is configured for actuation in accordance with Transport Security Administration (TSA) requirements and thus is operable with a TSA master key. The first locking mechanism 316 is operable between two states; a first state in which the locking mechanism 316 interacts with and prevents movement of the locking bar 304 relative to the housing 302 and a second state in which the locking mechanism 316 permits movement of the locking bar 304 relative to the housing 302.

With reference to FIG. 9, the key lock 316 is linked to the locking bar 304 by a curved linking member 317 which is linearly movable along a plane parallel to the plane of movement of the locking bar 304. The linking member 317 is connected to the key lock 316 by an arm 316*a* such that actuation of the key lock 316 from a locked position to an unlocked position causes the arm 316*a* to rotate which, in turn, causes the linking member 317 to rotate with the arm 316*a* in a direction away from the locking bar 304. Due to the curvature of the interfacing parts of the linking member 317 and the locking bar 304, when the linking member 317 is rotated relative to the locking bar 304, the locking bar 304 can be moved from the locked position to the unlocked position against a biasing force acting on the locking bar 304.

The second locking mechanism 318 comprises a number combination lock. The number combination lock comprises three rotatable discs 318*a*, 318*b*, 318*c* each having numbering from 0 to 9 printed around their respective circumferences. The combination lock 318 further comprises a locking pin 319 which extends through the rotatable discs. The locking pin 319 comprises two parts, a first tube part 319*a* which is fixed relative to the combination lock 318 and a second cylindrical part 319*b* which is received into the tube part 319*a*. The second part 319*b* is linearly movable within the first part 319*a* between two positions along a plane parallel to the plane of movement of the linking member 317 and the locking bar 304. The locking pin 319 has a head portion 319*c* which interfaces with the linking member 317.

The combination lock 318 is operable between a locking state and an unlocking state. In the locking state, the combination lock 318 restricts movement of the second part 319*b* relative to the first part 319*a* of the pin 319 such that the locking bar 304 in combination with the linking member 317 cannot be moved to the unlocked position. In the unlocking state, which is achieved by arranging each of the discs 318 in a correct orientation according to a predetermined number combination, the combination lock 318 permits movement of the locking second part 319*b* relative to the first part 319*a* of the pin 319. When the second part 319*b* of the pin 319 is movable relative to the first part 319*a*, movement of the locking bar 304 in a direction away from the key cylinder 316 to an unlocked position also moves the linking member 317 and cylinder arm 316*a* toward the locking pin head 319*c* and, hence, the unlocked position. Thus, the locking apparatus can be unlocked even without actuation of the key cylinder and vice versa.

To facilitate movement of the locking bar from a locked position to an unlocked position, the locking bar 304 is attached to a button (not shown) which extends outside the housing and which is operable by a user. When the combination lock 318 or the key cylinder 316 is in an unlocking state, the button and hence the locking bar 304 is slidable relative to the housing in a direction away from the key cylinder 316 to the unlocked position.

The locking apparatus 300 further comprises electronic components 320 which are configured to detect operation of the first locking mechanism 316 and the locking bar 304 and to communicate operational information to remote devices such as a tracking device 100, 1000 described above. The electronic components comprise a memory 322, a memory controller 324, one or more central processing units (CPUs) 326, an accelerometer 328, a rotational position sensor 330, a linear position sensor 332, and radio frequency circuitry 334. In the embodiment depicted, the radio frequency circuitry 334 is configured to communicate wirelessly using any of a plurality of communication standards, protocols and technologies such as Global System for Mobile Communications (GSM), Bluetooth, Wireless Fidelity (Wi-Fi), ZigBee or any other suitable communication protocol. It will be appreciated that more than one communication module may be incorporated into the locking apparatus to increase the number of communication protocols via which the apparatus can communicate wirelessly.

The electronic components communicate over one more communication buses and are powered by a power system. The power system comprises a power source 336 such as a button battery, a power management system 338 and any other components associated with the generation, management and distribution of power to the various electronic components of the locking apparatus 300. The housing 302 comprises a removable portion (not shown) which is releasably attached to the rest of the housing 302 and which allows a user to gain access to the housing interior and, in particular, the region of the housing in which the battery 336 is situated so that the battery 336 can be replaced when it runs flat. The removable portion is arranged on a part of the housing 302 such that when the locking apparatus 300 is incorporated into a luggage the removable portion is exposed to the luggage interior. Thus, access to the battery compartment of the housing 302 via the removable portion can only be gained when the luggage is in an open state.

The rotational position sensor 330 comprises a potentiometer. In a preferred implementation, the potentiometer comprises a conductive or resistive track, having two end terminals, which at least partially surrounds the cylinder lock. The track is connected at its end terminals to apply a DC reference voltage across the track. A wiper is attached to and is fixed relative to the cylinder lock such that the wiper rotates as the cylinder lock rotates. The free end of the wiper remote from the cylinder lock contacts the track such that as the cylinder lock rotates, the wiper travels along the track, thus changing the position of contact of the wiper with the track. The wiper also comprises a terminal from which an output voltage signal may be read and processed by the CPU 326. When the wiper changes position along the track due to rotation of the cylinder lock, the output voltage of the wiper increases in proportion to distance from the positive terminal of the track. Thus, it is possible to determine the extent to which the cylinder lock has rotated and whether or not it has been moved to an open position.

Since actuation of the cylinder lock 316 by a key is usually a relatively fast, smooth procedure and since attempted tampering of the lock using, for example, a hairpin is usually a relatively erratic movement over a longer period of time, the processor is configured to distinguish between a key actuated event and a tampering event based upon detected movement patterns of the cylinder lock or physical force on the tactile sensor (as the case may be).

The rotational position sensor 330 is operable to transmit a signal relating to a detection of rotation by a key to the CPU 326 for processing and storing in the memory 322. A detected key interaction event is stored in memory 322 along with a time stamp to indicate when the physical event occurred and, thus, record when a key was inserted into the key cylinder 316. When the locking apparatus 300 is used in conjunction with a tracking device 100, 1000, a recorded interaction event can also be associated with the coordinates of a specific location at the moment the event is recorded as determined by the GPS module 1014 of the tracking device 100, 1000.

Other types of sensors in various arrangements may be used for monitoring the cylinder lock 316 as will be apparent to a person skilled in the art. For example, as an alternative or addition to the rotational position sensor 330, a tactile sensor may be arranged inside the housing 302 at the end of the cylinder lock 316 remote from the cylinder lock key opening. The tactile sensor can be configured to detect a mechanical force being applied to the sensor. The tactile sensor can be arranged relative to the cylinder lock 316 such that, when a key is inserted into the cylinder lock 316, the end of the key imparts a mechanical force onto the sensor. Thus, the sensor can detect when a key has been fully inserted into the cylinder lock 316.

The linear position sensor 332 is associated with the locking bar 304 and is operable to detect linear movement of the locking bar 304 relative to the housing 302. In the embodiment depicted, the linear position sensor 332 comprises a straight conductive or resistive track having two terminal ends. A wiper having its own terminal is fixed relative to the locking bar 304 and arranged in sliding contact with the straight track. Together, the track and terminal form a potential divider operable to detect a change in voltage as the position of the wiper and, hence, the locking bar 304 moves relative to the track. The linear position sensor 332 is electrically coupled to a current transformer 334 which is used to configure data recorded from the linear position sensor 332 and forward the data to the CPU 326 for processing.

By tracking movement of the locking bar 304 it is possible to determine by process of elimination whether or not the combination lock 318 has been activated. In the event the cylinder lock 316 is not detected by the sensors as having been actuated but the locking bar 304 is detected as having moved from a locking state to an unlocking state, the CPU 326 is able to determine that the combination lock 318 has been activated.

It will be apparent to a person skilled in the art that in addition to monitoring the locking bar 304 or as an alternative to monitoring the locking bar 304, one or more sensors could be associated with the second locking mechanism 318, in this case the combination lock 318, to directly monitor actuation of the second locking mechanism 318. A suitable sensor is a rotational sensor 333 as described above comprising a resistive track having end terminals and a wiper having its own terminal and fixed to the axle and movable with the disc relative to the track. The resulting combination forms a potentiometer for monitoring rotation of one or more combination locks through measuring the changing voltage as the wiper moves with the combination disc relative to the track.

In addition to the rotational sensor 333 for detecting rotation of one or more combination discs, a pressure sensor 335 may be arranged relative to the combination locking pin 319 to measure the absence or presence of a force applied to the sensor by the locking pin head 319*c*. In this arrangement, linear movement of the combination pin head 319*c* away from or toward the pressure sensor 335 is detected by the pressure sensor 335. The output from the pressure sensor 335 may be used by the CPU 326 to determine whether the locking pin 319 is moving from a locking position to an unlocking position or vice versa. As above, since the movement pattern of the locking pin 319 is likely to be relatively smooth and continuous when genuinely unlocked and relatively erratic for a tampering event, the CPU is configured to distinguish between the two types of event depending on the detected movement pattern of the locking pin 319.

The CPU 326 runs one or more software programs stored in the memory 322 to perform functions for the locking apparatus 300 and to process data. The software programs comprise a communication module and a status module. The communication module comprises a set of instructions for generating signals for transmission to other electronic communication devices and for handling data received by the RF circuitry 334. The status module comprises a set of instructions for processing data received from other electronic communication devices via the communication module, data received from the accelerometer 328, and data received from the rotation sensors 330, 333, pressure sensor 335 and linear position sensor 332. The status module is operable to determine when the locking apparatus 300 should be switched between sleep and awake states, and also to determine when an unlocking event is detected and to record the unlocking event in the memory 322 along with a time stamp. The status module is also operable to transmit status information to a remote electronic communication device via the communication module.

The software programs further comprise a passenger information module which comprises a set of instructions for storing and transmitting data relating to a user of the apparatus and the intended movements of the passenger. For example, the data may comprise a passenger's travel itinerary, passenger identification information, and information relating to the departure location and arrival location such as a specified airport terminal, transportation network locations (taxi ranks, bus stops and train stations) and baggage collection areas. The passenger information module is operable to transmit useful quick reference information to a remote device such as a passenger's smartphone to enable the passenger to have quick access to required information.

It will be appreciated by a person skilled in the art that different combinations of locking mechanisms and sensors may be implemented. For example, for a locking apparatus comprising only a single locking mechanism such as a key cylinder, a single sensor may be used to monitor the locking mechanism or the locking bar. Alternatively, two sensors may be used, a first sensor to monitor the locking mechanism and a second sensor to monitor the locking element.

In use, the locking apparatus 300 is incorporated into the body of an item of luggage such that the longitudinal axis of the housing 302 is substantially aligned with a straight section of zipper track of the luggage. Therefore, the locking bar 304 and, hence, the two projections 306, 308 are linearly moveable in a direction substantially parallel to the zipper track. Thus, where the zipper comprises two zipper sliders with corresponding pull tabs, the two pull tabs may be arranged to extend from the zipper track into the two apertures 312, 314 of the housing 302 for engagement with the two projections 306, 308 as described above.

It will be appreciated by the person skilled in the art that the locking apparatus may comprise a standalone self-contained device such as a padlock that can be used with the luggage to secure the luggage.

The locking apparatus 300 is operable to communicate with a remote electronic communication device such as a smartphone via the RF circuitry 334. The smartphone may comprise a software application stored in memory which is operable to communicate with the locking apparatus via the smartphone and obtain status information from the locking apparatus 300.

When in an awake state, the locking apparatus 300 is configured to periodically transmit status information via Bluetooth to the smartphone. If no Bluetooth enabled device is within range of the locking apparatus 300, the locking apparatus 300 stores status information and recorded events for later transmission when a Bluetooth enabled device such as a smartphone comes within range. The status information comprises the last recorded locking status i.e. "locked" or "unlocked" as detected by the sensors 330, 332, 333 and 335, and details of any previous unlocking events as detected by the sensors. An unlocking event is detected by the rotational position sensor 330 when the sensor is detects rotation of the key cylinder 316. An unlocking event is also detected by the linear position sensor 332 and/or the pressure sensor 335 when movement of the locking bar 304 and second pin part 319*b* relative to the first pin part 319*a* occurs.

In addition, owing to the sensitivity of the position sensor 332 and the pressure sensor 335, the locking apparatus 300 is operable to detect smaller movements in the locking bar 304 which may not exceed the threshold to trigger an unlocking event but which may be sufficient to indicate a tampering event. The status information may therefore include details of tampering events. Each recorded event is associated with a time stamp to indicate when the event took place. Furthermore, each recorded event is associated with a particular sensor 330, 332, 333, 335, to distinguish between an unlocking event actuated by the key cylinder 316 and an unlocking or tampering event actuated by the combination lock 318. Thus, the locking apparatus 300 is capable of determining whether the locking apparatus 300 is unlocked via the key cylinder part 316, perhaps using a TSA master key, or by the combination lock 318 by an unauthorised third party.

The software application also permits a user to query the locking apparatus 300 to determine status information. For example, if a user wishes to determine the locking status of an item of luggage, the user may instruct the software application to transmit a query message from the smartphone either directly to the locking apparatus over Bluetooth frequencies or via a GSM network, where available. The transceiver of the locking apparatus receives the message for processing by the processing module and transmits a response message with status information. In addition, the processing module is configured to transmit status information to the user immediately upon detection of an unlocking or tampering event so that the user is alerted to the event and can act accordingly.

When the locking bar 304 is in the first position, the locking apparatus 300 assumes that it is in a locked state as the two projections 306, 308 extend across the apparatus in a locking configuration. However, in the first position, since the pull tabs of a pair of zippers may not necessarily be seated in the two apertures 312, 314 and retained in place by the two projections 306, 308 and since the combination lock 318 or the key lock 316 may be in an open position thereby permitting the locking bar 304 to be moved to the unlocked position, the software application on a smartphone comprises means for calibrating the locking apparatus 300 to specify if the locking apparatus 300 is in a locked or unlocked state. It is therefore the user's responsibility to ensure the pull tabs are secured in place and the locking apparatus 300 is set to a locked configuration and to use the software application to specify that the locking apparatus is 'locked'. Thus, after the user has parted with the luggage and until the user is reunited with the luggage, any event detected by the sensors 330, 332, 333, 335 of the locking apparatus 300 may be recorded as an unlocking event or a tampering event and transmitted or stored for later transmission to the smartphone accordingly.

The status module is operable to process data from the accelerometer 328 to switch the locking apparatus into a "sleep" state when no relative movement is detected or an "airplane" mode when an acceleration profile is detected which corresponds to the acceleration profile of an aircraft during take-off, both for safety purposes and for power saving. The status module is also operable to switch the locking apparatus to an "awake" state when relative movement is detected or when a deceleration profile is detected which corresponds to a deceleration profile of an aircraft during landing. The processing module may comprise a timer to delay switching between the sleep, airplane and awake states when relative movement, or absence thereof, or an acceleration or deceleration profile is detected.

Figure 11:
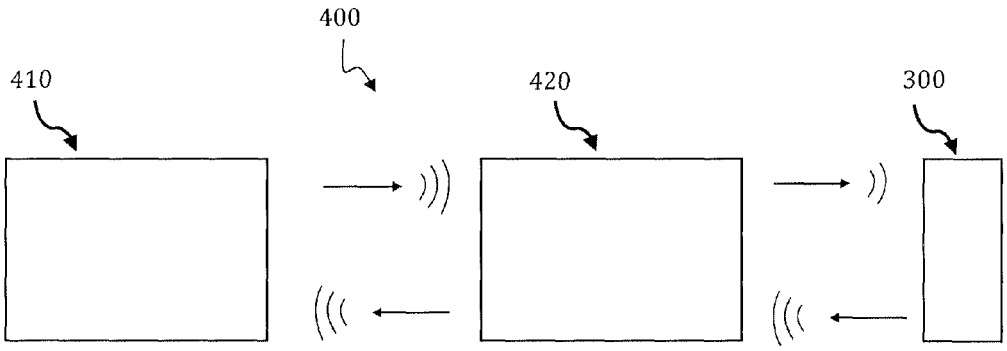
FIG. 11: shows a schematic representation of a monitoring system comprising a locking apparatus as shown in FIG. 8*a*.

The locking apparatus 300 may form part of a wider system 400 for monitoring and tracking luggage. With reference to FIG. 11, the system 400 may comprise a locking apparatus 300 as described above, a remote computer server 410 comprising a software management program and one or more smartphones 420 comprising a software application configured to communicate with the devices of the system. Each component of the system may work together to provide reliable status information.

The management platform may form a centralised processing unit for processing data from a plurality of electronic communication devices such as smartphones, tracking devices and locking apparatus. Thus, where there are a plurality of users of the tracking and monitoring system, each user may register an individual account with the management platform and associate their respective tracking devices and locking apparatus with their account. The management platform therefore maintains a centralised unit storing status and positional information to be interrogated by a plurality of different users to determine the status of their respective luggage via an electronic communication device comprising appropriate software.

Figure 12:
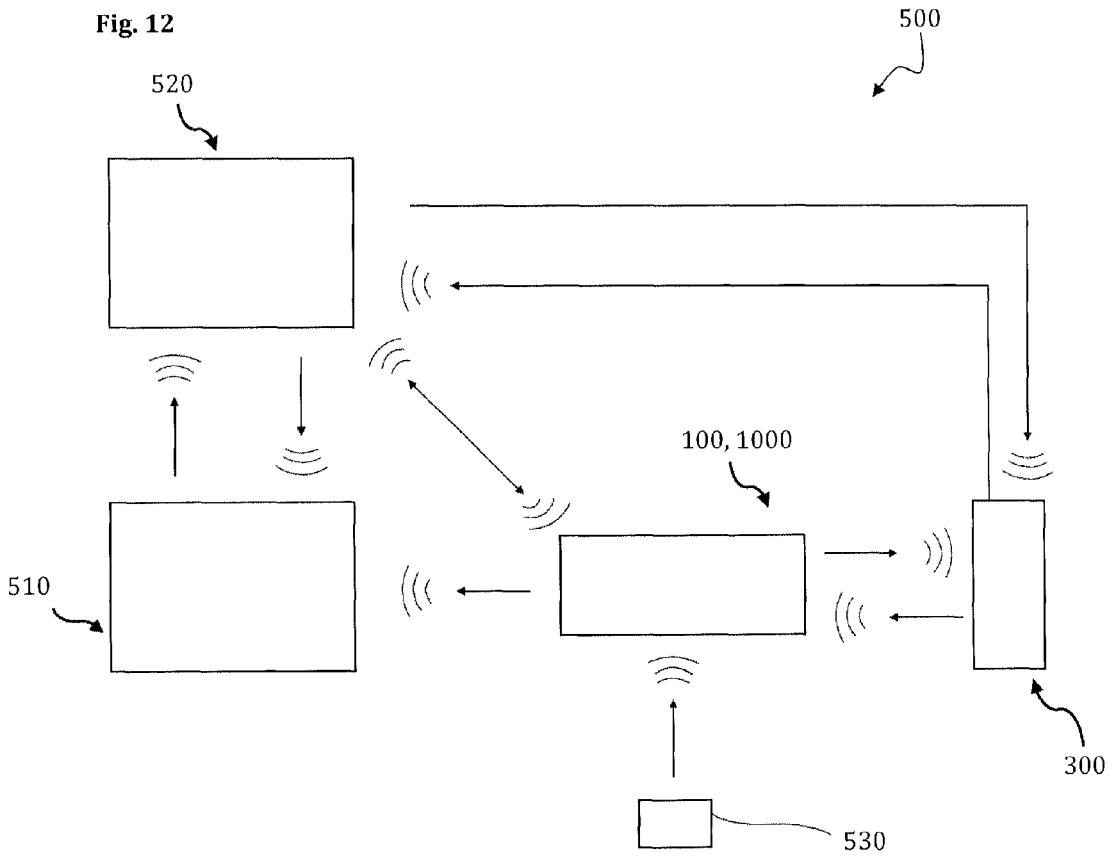
FIG. 12: shows a schematic representation of a tracking and monitoring system comprising a tracking device as shown in FIG. 6 and a locking apparatus as shown in FIG. 8*a*.

With reference to FIG. 12, in a wider system additionally comprising a tracking device 100, 1000, the tracking device 100, 1000 and the locking apparatus 300 may be operable to communicate directly with a smartphone 520 via Bluetooth or over a GSM network. The tracking device 100, 1000 and the locking apparatus 300 are also operable to communicate with one another to share status and positional information. For example, the locking apparatus 300 may transmit a request to the tracking device 100, 1000 for positional information when an unlocking or tampering event is detected so that the positional information can be recorded in the locking apparatus memory by the status module along with a time stamp and the type of event detected e.g. unlocking event by TSA lock, unlocking event by combination lock or tampering event by combination lock.

Furthermore, the tracking device 100, 1000 may perform the function of an intermediate node for the locking apparatus 300 to permit signals to be relayed from the locking apparatus 300 to a smartphone 520 or server 510 via the tracking device 100, 1000 when the locking apparatus 300 is out of range of a Bluetooth enabled smartphone or other electronic communication device. Likewise, where the locking apparatus 300 has an available wireless connection and the tracking device does not, the locking apparatus may relay messages to the server 510 or smartphone 520 from the tracking device 100, 1000. The wider system 500 may additionally comprise one or more RFID readers 530 for transmitting positional information to the tracking device based upon received identification information from passing RFID tags of a tracking device or locking apparatus. Additionally or alternatively to RFID readers, the wider system 500 may comprise a cloud beacon having Bluetooth and Wi-Fi connectivity for communicating with the locking apparatus 300 and tracking device 100, 1000.

Various exemplary embodiments of the present invention will serve to provide end users, i.e. travellers, will an automated system that allows enhanced and reliable visibility surrounding the location and general condition of luggage articles.

By using a combination of transmitting capabilities and sensory technology, travellers will be able to not only track physical location of their luggage, but also monitor whether their luggage has been opened by TSA official, opened by the correct combination, any attempts to access the contents of their luggage have been made by unauthorised persons, whether their luggage is airborne, i.e. airplane mode, or been safely stored away in a closet of their choosing, for example the device may indicate offline mode.

The present invention has been designed, from a user perspective, to provide an automated system that demands minimal involvement from end users. The tracking device can automatically determine when to transmit or not transmit, knowing when to alert travellers of information that is deemed important to the defined user and inform the user when the tracking device will need to be recharged.

Moreover, the present invention provides all functionality at minimal cost, without data roaming charges, and with high priority transmitting channels, i.e. USSD messaging over GSM networks, ensuring that users can reliably locate and monitor the condition of their luggage even when a luggage article is in the most remote locations. This method of transmitting requires reduced levels of power usage when compared to other transmission forms, enabling the device to retain electrical power for prolonged periods of time.

Furthermore, the present invention's accompanying simple and easy to use online platforms not only provide users with the ability to monitor their luggage, but also creates value for markets through the use of greater access and engagement to existing and potential customers through a new medium.

The present invention addresses the increased need for informational services, allowing travellers to monitor the status of their luggage at the touch of a button, taking advantage of current socioeconomic trends, and may one day eliminate the risk of mishandled luggage to efficiently reunite travellers with their luggage.

The invention claimed is:

1. A locking apparatus configured to be mounted within an item of luggage for securing said item of luggage, comprising:

a locking element which is movable between a first position in which the locking apparatus secures the item of luggage in a locked state and a second position in which the locking apparatus and item of luggage is in an unlocked state, a first lock mechanism operable to control movement of the locking element between the first position and the second position, a first sensor arranged to detect operation of at least the first lock mechanism, and a second sensor actuable by movement of the locking element between the first position and the second position.

2. The locking apparatus as claimed in claim 1, wherein the second sensor detects movement of the locking element separate from operation of the first lock mechanism.

3. The locking apparatus as claimed in claim 1, wherein the first lock mechanism comprises a mechanically actuated locking mechanism.

4. The locking apparatus as claimed in claim 3, wherein the mechanically actuated locking mechanism is a key operable locking mechanism.

5. The locking apparatus as claimed in claim 1, further comprising a second lock mechanism operable to control movement of the locking element between the first position and the second position.

6. The locking apparatus as claimed in claim 5, further comprising an additional sensor associated with the second lock mechanism for detecting operation of the second lock mechanism.

7. The locking apparatus as claimed in claim 5, wherein the second lock mechanism comprises a mechanically actuated locking mechanism.

8. The locking apparatus as claimed in claim 1, wherein the locking element comprises a bar which is linearly movable between the first and second positions.

9. The locking apparatus as claimed in claim 2, wherein one or more of the sensors are electronic sensors.

10. The locking apparatus as claimed in claim 2, wherein one or more sensors comprises a tactile sensor configured to detect the application of a physical force.

11. The locking apparatus as claimed in claim 2, wherein one or more sensors comprises a position sensor operable to detect movement.

12. The locking apparatus as claimed in claim 2, further comprising a transmitter for wirelessly transmitting data.

13. The locking apparatus as claimed in claim 1, further comprising a receiver for receiving wireless data transmissions.

14. A locking apparatus configured to be mounted within an item of luggage for securing said item of luggage, comprising:

a housing configured and dimensioned to be disposed within the item of luggage;

a locking element movable relative to the housing between a first position in which the locking apparatus is in a locking configuration for preventing opening of the item of luggage and a second position in which the locking apparatus is in an unlocking configuration;

a key cylinder extending at least partially into the housing and operated by a key, the key cylinder configured to restrict movement of the locking element from the first position to the second position when the key cylinder is set to a locking state, the key cylinder configured to permit movement of the locking element from the first position to the second position when actuated by a key;

a first sensor actuable by a key inserted into the key cylinder;

a second sensor actuable by movement of the locking element between the first position and the second position;

a central processing unit to process data received from the first sensor and the second sensor;

a memory to store data processed by the central processing unit; and a transceiver to transmit and receive wireless signals comprising data received from the first and second sensors.

15. A method of monitoring locking status of a locking apparatus in an item of luggage, wherein the locking apparatus includes a locking element acuatable by a lock mechanism to move between locked and unlocked positions; the method comprising steps of:

monitoring the lock mechanism to detect actuation of the lock mechanism with a first sensor;

monitoring the locking element with a second sensor to detect movement of the locking element separate from actuation of the lock mechanism;

storing as data one or more detected actuations of the lock mechanism or detected movements of the locking element in a memory, wherein said data distinguishes between actuations of the lock mechanism and detected movements of the locking element separate from actuation of the lock mechanism; and displaying said data on a graphical user interface.

16. The method as claimed in claim 15, wherein said displaying said data comprises wirelessly transmitting and displaying said data to a user on a device separate from said item of luggage.

17. The method as claimed in claim 15, further comprising the step of monitoring a second locking mechanism to detect actuation of the second locking mechanism.

18. The method as claimed in claim 15, further comprising the step of transmitting data related to one or more detected actuations or movements to an electronic device remote from the locking apparatus.

19. A locking apparatus configured to be mounted within an item of luggage to secure said item of luggage and detect unauthorized opening thereof, the locking apparatus comprising:

a locking element operable between a first position in which the locking apparatus secures the item of luggage in a locked state and a second position in which the locking apparatus and item of luggage is in an unlocked state and openable;

a first lock mechanism operable to control movement of the locking element between the first position and the second position, and first and second sensors for detecting operation of the first lock mechanism and movement of the locking element separate from operation of said first lock mechanism.

20. The locking apparatus as claimed in claim 19, wherein said first and second sensors comprise a first sensor associated with the first lock mechanism for detecting operation of said first mechanism and a second sensor associated with the locking element for detecting movement of the locking element.

21. The locking apparatus as claimed in claim 20, further comprising a second lock mechanism operable to control movement of the locking element between the first position and the second position separately from the first lock mechanism.

22. The locking apparatus as claimed in claim 20, wherein said sensor means further comprises a third sensor associated with the second lock mechanism for detecting operation of the second lock mechanism.

23. The locking apparatus as claimed in claim 19, comprising in combination the item of luggage, wherein:

said item of luggage comprises a luggage body and a luggage lid for closing the luggage body;

said locking apparatus is disposed in a housing positioned in one of the luggage body or luggage lid; and said locking element comprises a bar linearly movable between a first locking position engaged between the luggage lid and luggage body and a second unlocking position disengaged between the luggage body and luggage lid when actuated by the lock mechanism.

* * * * *